US007004345B2

(12) United States Patent
Turner et al.

(10) Patent No.: US 7,004,345 B2
(45) **Date of Patent: *Feb. 28, 2006**

(54) CAN END

(75) Inventors: Timothy Turner, Pecatonica, IL (US); Rajesh Gopalaswamy, Lake Zurich, IL (US); Randy G. Forrest, Park Ridge, IL (US)

(73) Assignee: Rexam Beverage Can Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/219,914

(22) Filed: Aug. 15, 2002

(65) Prior Publication Data

US 2003/0042258 A1 Mar. 6, 2003

Related U.S. Application Data

(63) Continuation-in-part of application No. 09/931,497, filed on Aug. 16, 2001, now Pat. No. 6,772,900.

(51) Int. Cl.
*B65D 17/34* (2006.01)
*B65D 51/18* (2006.01)

(52) U.S. Cl. ..... 220/269; 220/254.1; 220/359.2; 220/619

(58) Field of Classification Search ..... 220/269, 220/619, 620, 623, 624, 254.1, 254.3, 359.1, 220/359.2, 359.4; 413/4, 11, 17
See application file for complete search history.

(56) References Cited

U.S. PATENT DOCUMENTS

| | | | |
|---|---|---|---|
| 3,186,583 | A | 6/1965 | Zundel |
| 3,434,623 | A | 3/1969 | Cookson |
| 3,525,455 | A | 8/1970 | Saunders |
| 3,705,563 | A | 12/1972 | Elser |
| 3,765,352 | A | 10/1973 | Schubert et al. |
| 3,837,524 | A | 9/1974 | Schubert et al. |
| 3,853,080 | A | 12/1974 | Zundel |
| 3,868,919 | A | 3/1975 | Schrecker et al. |
| 3,871,314 | A | 3/1975 | Strargell |
| 3,941,277 | A | 3/1976 | McKinney et al. |
| 3,945,334 | A | 3/1976 | Ostrem et al. |
| 3,990,376 | A | 11/1976 | Schubert et al. |
| 4,031,837 | A | 6/1977 | Jordan |
| 4,055,134 | A | 10/1977 | Ostrem et al. |
| 4,084,721 | A | 4/1978 | Perry, deceased |
| 4,093,102 | A | 6/1978 | Kraska |
| 4,116,361 | A | 9/1978 | Stargell |

(Continued)

FOREIGN PATENT DOCUMENTS

| | | |
|---|---|---|
| DE | 2 303 943 | 5/1974 |

(Continued)

OTHER PUBLICATIONS

U.S. Appl. No. 09/863,160, filed Nov. 8, 2001, Fields.

(Continued)

*Primary Examiner*—Nathan J. Newhouse
(74) *Attorney, Agent, or Firm*—Wallenstein Wagner & Rockey, Ltd.

(57) ABSTRACT

A can end member has a central panel, a circumferential chuckwall, and a transition wall. The central panel is centered about a longitudinal axis and has a peripheral edge. The curl defines an outer perimeter of the end member. The circumferential chuckwall extends downwardly from the curl to the transition wall. The transition wall connects the chuckwall with the peripheral edge of the central panel. The transition wall has a folded portion extending outwardly relative to the longitudinal axis.

41 Claims, 15 Drawing Sheets

U.S. PATENT DOCUMENTS

| | | | | |
|---|---|---|---|---|
| 4,217,843 | A | 8/1980 | Kraska | |
| 4,324,343 | A | 4/1982 | Moller | |
| 4,434,641 | A | 3/1984 | Nguyen | |
| 4,448,322 | A | 5/1984 | Kraska | |
| 4,571,978 | A | 2/1986 | Taube et al. | |
| 4,577,774 | A | 3/1986 | Nguyen | |
| 4,641,761 | A | 2/1987 | Smith et al. | |
| 4,680,917 | A | 7/1987 | Hableton | |
| 4,685,849 | A | 8/1987 | LaBarge et al. | |
| 4,704,887 | A | 11/1987 | Bachmann et al. | |
| 4,722,215 | A | 2/1988 | Taube et al. | |
| 4,804,106 | A | 2/1989 | Saunders | |
| 4,832,223 | A | 5/1989 | Kalenak et al. | |
| 4,991,735 | A | 2/1991 | Biondich | |
| 5,069,355 | A | 12/1991 | Matuszak | |
| 5,105,977 | A | 4/1992 | Taniuchi | |
| 5,143,504 | A | 9/1992 | Braakman | |
| 5,174,706 | A | 12/1992 | Taniuchi | |
| 5,823,730 | A | 10/1998 | La Rovere | |
| 5,950,858 | A | 9/1999 | Sergeant | |
| 6,024,239 | A | 2/2000 | Turner et al. | |
| 6,065,634 | A | 5/2000 | Brifcani et al. | |
| 6,089,072 | A | 7/2000 | Fields | |
| 6,234,337 | B1 | 5/2001 | Huber et al. | |
| 6,419,110 | B1 | 7/2002 | Stodd | |
| 6,499,622 | B1 | 12/2002 | Neiner | |
| 6,772,900 | B1 * | 8/2004 | Turner et al. | 220/269 |
| 2002/0158071 | A1 | 10/2002 | Chasteen et al. | |

FOREIGN PATENT DOCUMENTS

| | | |
|---|---|---|
| DE | 25 54 264 | 6/1977 |
| DE | 8228681 U | 10/1983 |
| WO | WO 96/37414 | 11/1996 |
| WO | WO 98/34743 | 8/1998 |
| WO | WO 01/41948 | 6/2001 |
| WO | WO 02/00512 | 1/2002 |
| WO | WO02/00512 A | 1/2002 |
| WO | WO02/43895 | 6/2002 |
| WO | WO02/057137 | 7/2002 |
| WO | WO02/057148 | 7/2002 |

OTHER PUBLICATIONS

U.S. Appl. No. 09/905,310, filed May 2, 2002, Ball et al.

Great Britain Provisional Specification for "Improvements in or relating to Closured Tins, Jars, or like Containers," Patent No. 422,052, by Robert Barlow, and Arthur Leslie Stuchbery, Complete Specification Accepted: Dec. 31, 1934, Application Date: Jun. 29, 1933.

Australia Complete Specification for "Improvements in the manufacture of tins or sheet metal containers, cans and the like," Patent No. 107,340, by Saml. Hanson & Son, Limited, Accepted: May 3, 1939, Application Date: May 3, 1938.

* cited by examiner

FIG. 22
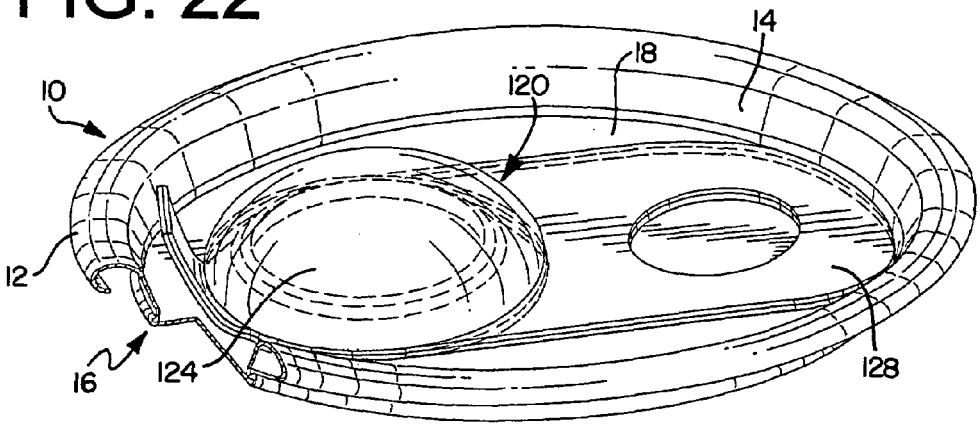
FIG. 23
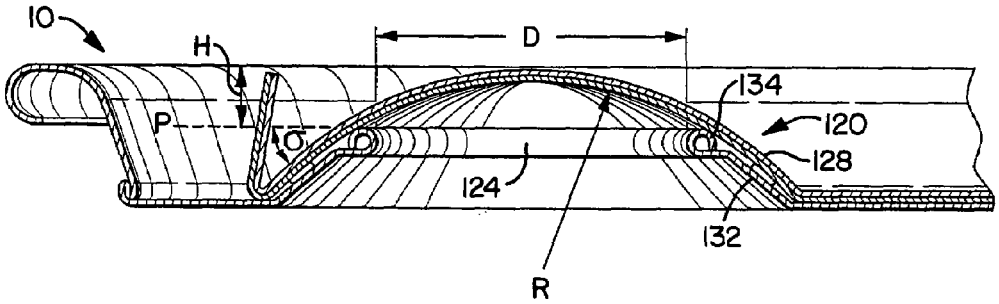
FIG. 24
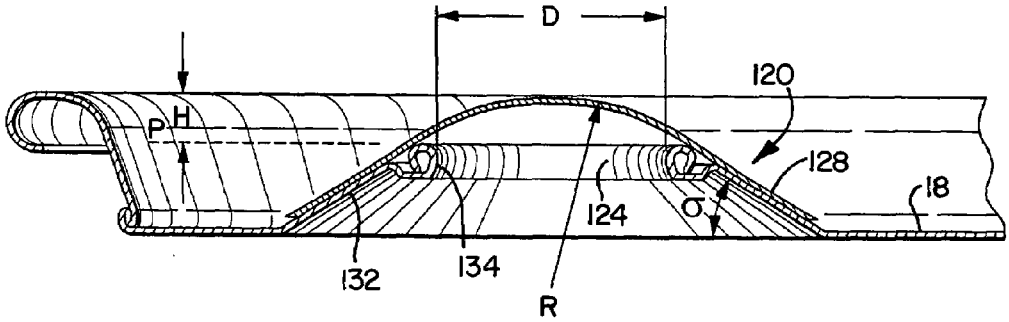
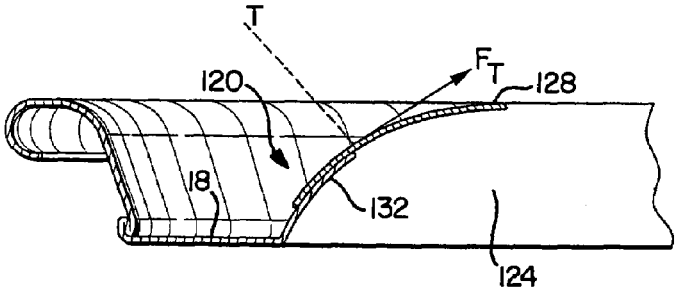
FIG. 25

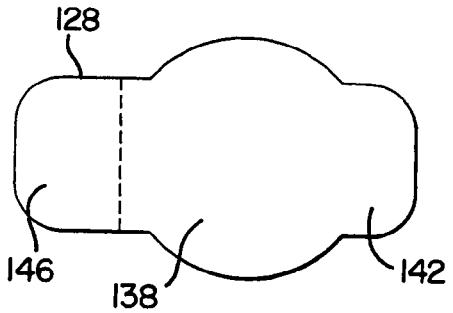
FIG. 26
FIG. 27
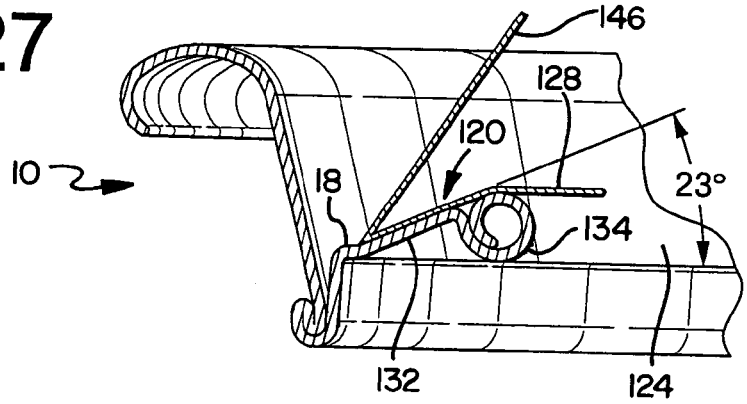
FIG. 28
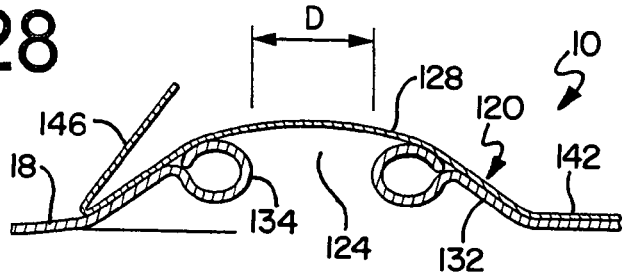
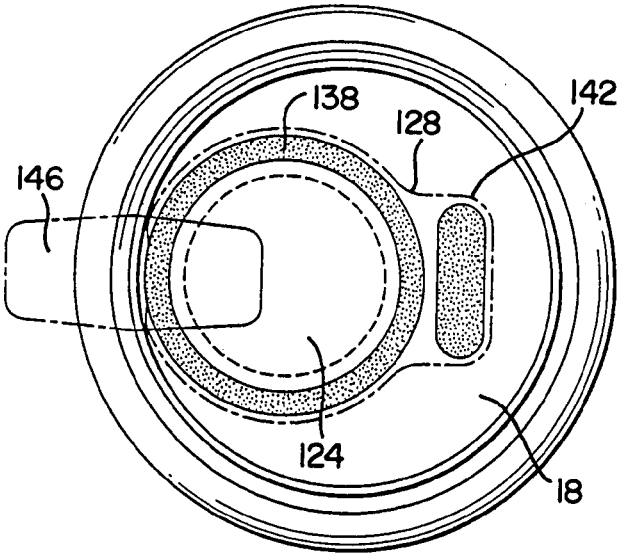
FIG. 29

CAN END

RELATED APPLICATION

This application is a continuation-in-part of application Ser. No. 09/931,497 filed on Aug. 16, 2001, now U.S. Pat. No. 6,772,900, which is commonly assigned and incorporated by reference herein.

TECHNICAL FIELD

The present invention relates to end closures for two-piece beer and beverage metal containers having a non-detachable operating panel. More specifically, the present invention relates to a method of reducing the volume of metal in an end closure.

BACKGROUND OF THE INVENTION

Common easy open end closures for beer and beverage containers have a central panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

One goal of the can end manufacturers is to provide a buckle resistant end. U.S. Pat. No. 3,525,455 (the '455 patent) describes a method aimed at improving the buckle strength of a can end having a seaming curl, a chuckwall, and a countersink along the peripheral edge of a central panel. The method includes forming a fold along at least substantially the entire length of the chuckwall. The fold has a vertical length that is approximately the same length as the seaming curl, and a thickness that is approximately equal to the length of the remaining chuckwall wherein the fold is pressed against the interior sidewall of the container when the end is seamed to the container's open end.

Another goal of the manufacturers of can ends is to reduce the amount of metal in the blank end which is provided to form the can end while at the same time maintaining the strength of the end. One method aimed at achieving this goal is described in U.S. Pat. No. 6,065,634 (the '634 patent). The '634 patent is directed to a can end member having a seaming curl, a chuckwall extending downwardly from the seaming curl to a countersink which is joined to a central panel of the can end. The method of the '634 patent reduces the amount of metal by reducing the cut edge of the blank. This is accomplished by increasing the chuckwall angle from approximately 11–13 degrees to an angle of 43 degrees.

The method of the '634 patent may decrease the diameter of the central panel. This could reduce area on the central panel that is needed for written instructions, such as opening instructions or recycling information. It may also restrict the size of the tear panel. Furthermore, because the angle of the chuckwall is increased, the space between the perimeter of the can end and the tear panel is increased. This could cause spillage during pouring and/or drinking.

The method of the '634 patent also produces a countersink. The '455 patent shares this aspect. The countersink is provided in the can end to improve strength. However, because the countersink is a narrow circumferential recess, dirt will often collect within the countersink. Additionally, the dirt is often difficult to rinse away due to the geometry of the countersink.

SUMMARY OF THE INVENTION

One object of the present invention is to provide an easy open can end member comprising a central panel, a seaming curl, a circumferential chuckwall, and a transition wall. The central panel is centered located about a longitudinal axis and has a peripheral edge. The seaming curl defines an outer perimeter of the end member. The chuckwall extends downwardly from the seaming curl. The transition wall connects the chuckwall with the substantially planar peripheral edge of the central panel. The transition wall comprises a folded portion extending outwardly relative to the longitudinal axis.

Another object of the present invention is to provide an easy open can end member comprising a central panel, a seaming curl, a circumferential chuckwall, and a transition wall. The central panel is centered about a longitudinal axis and has a peripheral edge. The curl defined an outer perimeter of the end member. The circumferential chuckwall extends downwardly from the curl. The transition wall connects the chuckwall with the peripheral edge of the central panel. The transition wall comprises a folded portion. The folded portion includes a convex annular apex joining a first leg and a second leg, the first leg joining the transition wall with the chuckwall, and the second leg joining the transition wall with the peripheral edge.

Another object of the present invention is to provide an easy open can end member comprising a central panel, a seaming curl, a circumferential chuckwall, and a transition wall. The central panel is centered about a longitudinal axis and has a public side and a product side. The curl defines an outer perimeter of the end member. The circumferential chuckwall extends downwardly from the curl. The transition wall connects the chuckwall with the peripheral edge of the central panel. The transition wall comprises a fold including a concave annular portion approaching the peripheral edge of the central panel.

Other features and advantages of the invention will be apparent from the following specification taken in conjunction with the following drawings.

BRIEF DESCRIPTION OF THE DRAWINGS

FIG. 22 is a perspective view of an embodiment of the including a peelably bonded closure;

FIG. 23 is a partial cross-sectional view of an embodiment of the can end of the present invention having a peelably bonded closure;

FIG. 24 is a partial cross-sectional view of an embodiment of the can end of the present invention having a peelably bonded closure;

FIG. 25 is a partial cross-sectional view of an embodiment of the can end of the present invention having a peelably bonded closure;

FIG. 26 is a top plan view of a peelable closure;

FIG. 27 is a partial cross-sectional view of an embodiment of the can end of the present invention having a peelably bonded closure;

FIG. 28 is a partial cross-sectional view of an embodiment of the can end of the present invention having a peelably bonded closure;

FIG. 29 is a top plan view of a container having a peelable closure;

DETAILED DESCRIPTION

Figure 1:
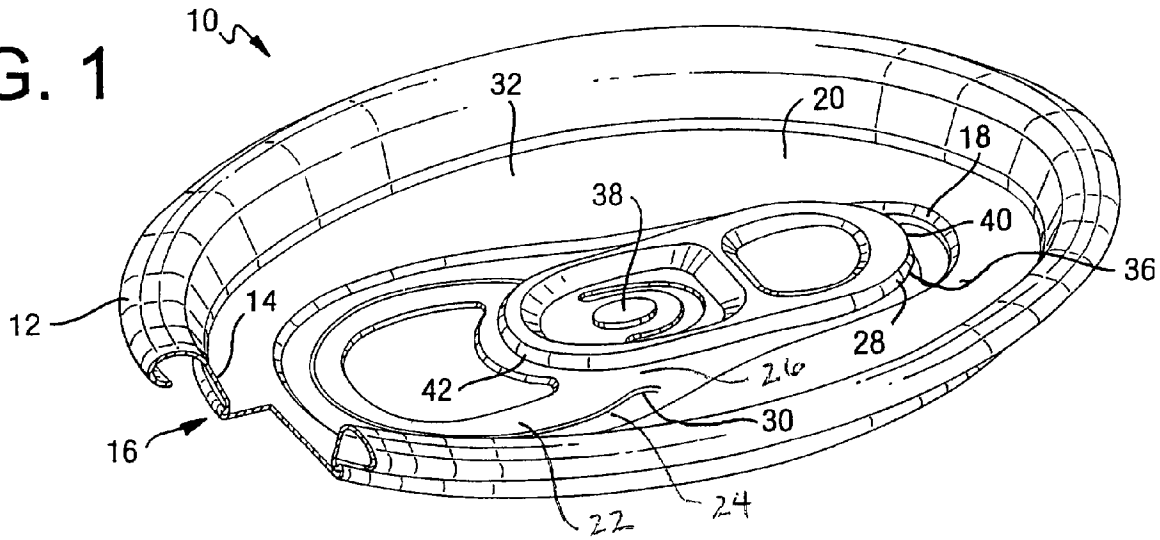
FIG. 1 is a perspective view of a can end of the present invention having a cutaway view of a portion of the perimeter.

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10 with improved physical properties including strength. Essentially, the present invention provides a lightweight end member 10 which embodies the physical characteristics and properties required in the beverage container market, as explained below.

Referring to FIG. 1, the end member 10 for a container (not shown) has a seaming curl 12, a chuckwall 14, a transition wall 16, and central panel wall 18. The container is typically a drawn and ironed metal can such as the common beer and beverage containers, usually constructed from a thin sheet of aluminum or steel that is delivered from a large roll called coil stock of roll stock. End closures for such containers are also typically constructed from a cut edge of thin sheet of aluminum or steel delivered from coil stock, formed into blank end, and manufactured into a finished end by a process often referred to as end conversion. In the embodiment shown in the Figures, the end member 10 is joined to a container by a seaming curl 12 which is joined to a mating curl of the container. The seaming curl 12 of the end closure 10 is integral with the chuckwall 14 which is joined to an outer peripheral edge portion 20 of the central panel 18 by the transition wall 16. This type of means for joining the end member 10 to a container is presently the typical means for joining used in the industry, and the structure described above is formed in the process of forming the blank end from a cut edge of metal sheet, prior to the end conversion process. However, other means for joining the end member 10 to a container may be employed with the present invention.

The central panel 18 has a displaceable closure member or, as shown in FIG. 1, a tear panel 22 defined by a curvilinear frangible score 24 and a non-frangible hinge segment 26. The hinge segment 26 is defined by a generally straight line between a first end 28 and a second end 30 of the frangible score 24. The tear panel 22 of the central panel 18 may be opened, that is the frangible score 24 may be severed and the tear panel 22 displaced at an angular orientation relative to the remaining portion of the central panel 18, while the tear panel 22 remains hingedly connected to the central panel 18 through the hinge segment 26. In this opening operation, the tear panel 22 is displaced at an angular deflection, as it is opened by being displaced away from the plane of the panel 18.

The frangible score 24 is preferably a generally V-shaped groove formed into the public side 32 of the central panel 18. A residual is formed between the V-shaped groove and the product side 34 of the end member 10.

The end member 10 has a tab 36 secured to the central panel 18 adjacent the tear panel 22 by a rivet 38. The rivet 38 is formed in the typical manner.

During opening of the end member 10 by the user, the user lifts a lift end 40 of the tab 36 to displace a nose portion 42 downward against the tear panel 22. The force of the nose portion 42 against the tear panel 22 causes the score 24 to fracture. As the tab 36 displacement is continued, the fracture of the score 24 propagates around the tear panel 22, preferably in progression from the first end 28 of the score 24 toward the second end 30 of the score 24.

Figure 2:
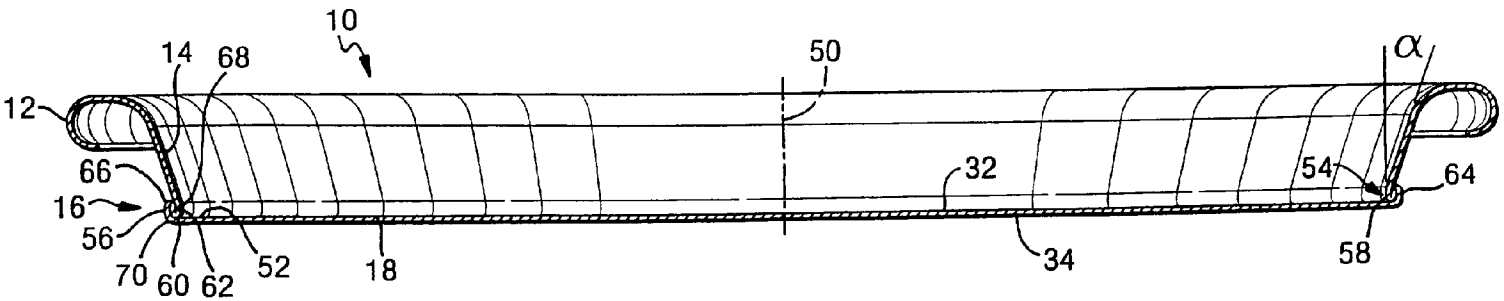
FIG. 2 is a partial cross-sectional view of a can end member of the present invention.

Now referring to FIG. 2, the central panel 18 is centered about a longitudinal axis 50. The seaming curl 12 defines an outer perimeter of the end member 10 and is integral with the chuckwall 14. The chuckwall 14 extends downwardly from the seaming curl 12 at an obtuse angle. A chuckwall angle $\alpha$ measured from a planar or substantially planar peripheral edge portion 52 of the central panel 18 is generally between 10 and 70 degrees, more preferably between 15 and 45 degrees, and most preferably 19 to 27 degrees, or any range or combination of ranges therein. The chuckwall 14 may be provided with a radius of curvature as shown in the drawings to improve performance within the forming tools used to form the end member 10. The radius of curvature helps prevent buckling within the tools as force is applied to the unfinished end member 10.

The transition wall 16 is integral with the chuckwall 14 and connects the chuckwall 14 the to the peripheral edge portion 52 of the central panel 18. The end member 10 differs from contemporary beverage can end members that typically include a countersink formed in the outer peripheral edge of the central panel. The planar peripheral edge portion 52 allows the tear panel 24 to be placed closer to the outer perimeter of the end member 10. It also provides additional central panel 18 area for printing and/or a larger tear panel opening.

The transition wall 16 includes a fold 54 extending outwardly relative to the longitudinal axis 50. The drawings show the fold 54 formed along an exterior portion of the chuckwall 14; however, it should be understood that the fold 54 can be located in other locations such as along the product side 34 of the central panel 18.

The fold 54 has a first leg 56 connecting the chuckwall 14 to an annular concave bend or portion 58. The annular concave portion 58 includes an apex 60 which approaches so as to preferably engage the outer peripheral edge 52 of the central panel 18. This contact between the apex 60 and the outer peripheral edge 52 helps to prevent dirt from accumulating along the peripheral edge 52 of the central panel 18. It also allows the central panel 18 to be easily cleaned when dirt or other residue is present on the central panel 18.

A second leg 62 extends upwardly from the annular concave portion 58 to an annular convex bend or portion 64. The second leg 62 can be vertical, substantially vertical, or up to ±25 degrees to the longitudinal axis 50 and can be pressed against an outer portion of the first leg 56.

The annular convex portion 64 includes an apex 66 which defines a vertical extent of the fold 54. A length of the fold 54 is substantially less than a length of the seaming curl 12. In combination with, inter alia, the angled chuckwall 14, this fold 54 structure and length allows the buckling strength of the end member 10 to meet customer requirements while decreasing the size of the cut edge blank and maintaining the diameter of the finished end. In other words, a smaller cut edge blank can be provided to produce the same sized diameter end member as a larger cut edge blank formed in the conventional manner with a countersink.

A third leg 68 extends downwardly from the annular convex portion 64 to a third bend 70 which joins the transition wall 16 to the outer peripheral edge 52 of the central panel 18. The third bend 70 has a radius of curvature which is suitable for connecting the third leg 68 to the planar outer peripheral edge of the central panel 18.

The third leg 68 can be pressed against an outer portion of the second leg 62. This gives the fold 54 a transverse thickness which is substantially equal to three times the thickness of the thickness of the chuckwall 14, and the transverse thickness of the fold 54 is substantially less than the length of the chuckwall 14. Again, this structure results in a metal savings by allowing the cut edge blank to be smaller than conventional cut edge blanks used to make the same diameter end member. For example, the average diameter of a cut edge blank used to form a standard 202 can end is approximately 2.84 inches while the average diameter of a cut edge blank used to form a 202 can end of the present invention is approximately 2.70 inches.

The end member 10 can be formed in a shell press, a conversion press, or a combination of both. For example, the end member 10 can be partially formed in the shell press and then completed in the conversion press. The end member 10 can also be finished in an alternate forming machine, such as a roll forming apparatus. Alternatively, the end member 10 can be all or partially roll formed before or after the conversion press.

FIGS. 3–8 and FIGS. 9–13, illustrate one method for forming an end member 10 of the present invention. FIGS. 3–8 show the progression of the end member 10 from a shell to the finished end 10 without the tooling. FIGS. 9–13 show the tooling contemplated for forming the end member 10. The method shows the fold 54 formed from a lower segment of the chuckwall 14 referred to as the transition wall 16 herein. However, it should be understood that the transition wall 16 can be formed from a portion of the peripheral edge 52 of the central panel 18 without departing from the spirit of the invention.

Figure 3:
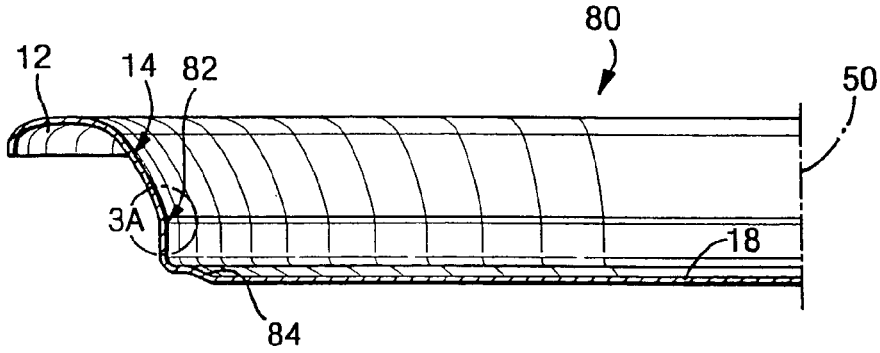
FIGS. 3–8 are partial cross-sectional views of a can end member of the present invention shown in forming stages.
Figure 3A:
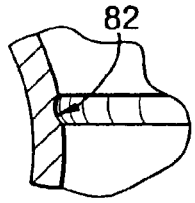
Figure 4:
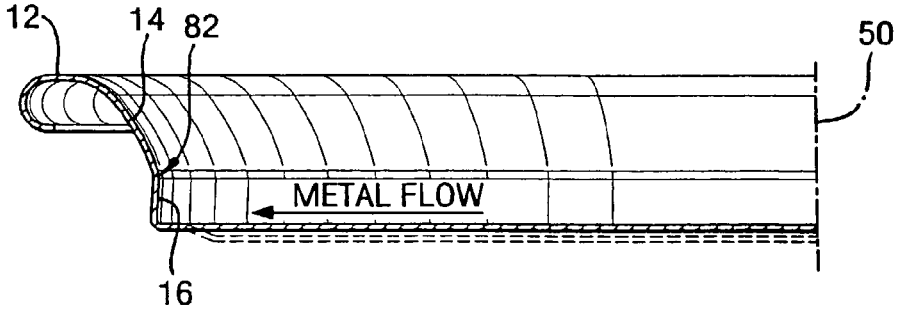
Figure 5:
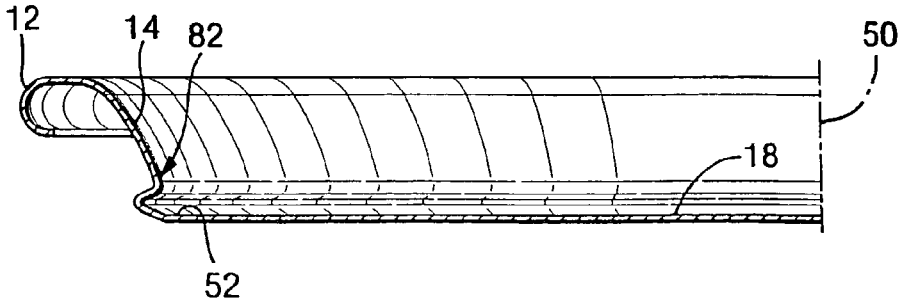
Figure 9:
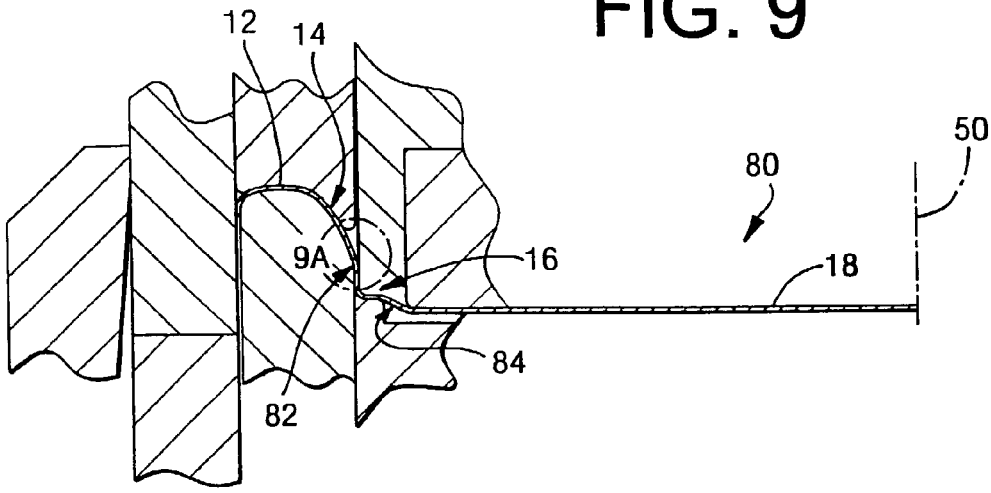
FIGS. 9–13 are partial cross-sectional views of a can end member and tooling of the present invention shown in forming stages.
Figure 9A:
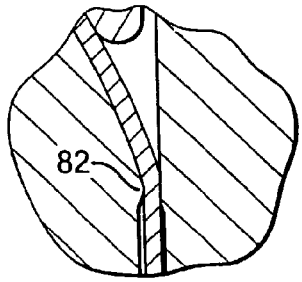
Figure 10:
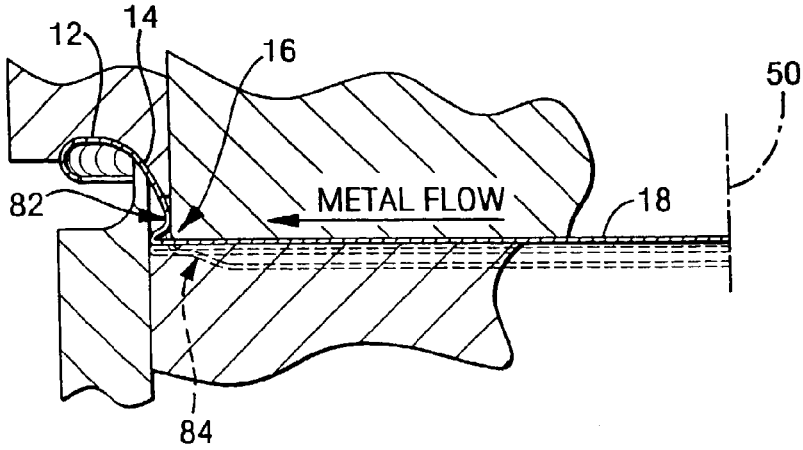

Referring to FIGS. 3 and 9, the method includes the step of providing an end shell 80. The end shell 80 includes a hinge point 82 formed at the junction between the chuckwall 14 and the transition wall 16. In FIG. 4, the hinge point 82 is a coined portion on an interior of the end shell 80. In FIG. 9, the hinge point 82 is a coin on the exterior of the end shell 80. The hinge point 82 may also be provided along the peripheral edge 52 of central panel 18. The hinge point 82 is provided to initiate bending at a predetermined point along the chuckwall 14/transition wall 16. In this example, the hinge point 82 defines the boundary between the chuckwall 14 and the transition wall 16.

The end shell 80 also includes an angled portion 84 along the peripheral edge 52 of the central panel 18. This angled portion is formed to promote stacking of the end shells 80 as they are transported from a shell press to a conversion press. The angled portion 84 also promotes metal flow outwardly relative to the longitudinal axis 50 to promote formation of the fold 54 in the conversion press.

FIGS. 4–8 and 10–13 show a process of converting the end shell 80 to the finished end member 10 in a four stage operation carried out in a conversion press. The illustrated process depicts a die forming operation; however, the can end 10 of the present invention can also be formed by any forming technique, e.g., roll forming.

In the first stage (FIGS. 4, 5 and 10), relative movement between the tooling members causes an outward bulge (the beginning of the annular convex portion 64) to form in the transition wall 16. The bending of the transition wall 16 is initiated at the hinge point 82 (the beginning of the annular concave portion 58). At the same time, the angled portion 84 of the peripheral edge 52 is flattened to form the peripheral edge 52 into a planar structure. The relative movement of the tooling also causes the hinge point 82 to move towards the flattened peripheral edge 52 of the central panel 18.

Figure 6:
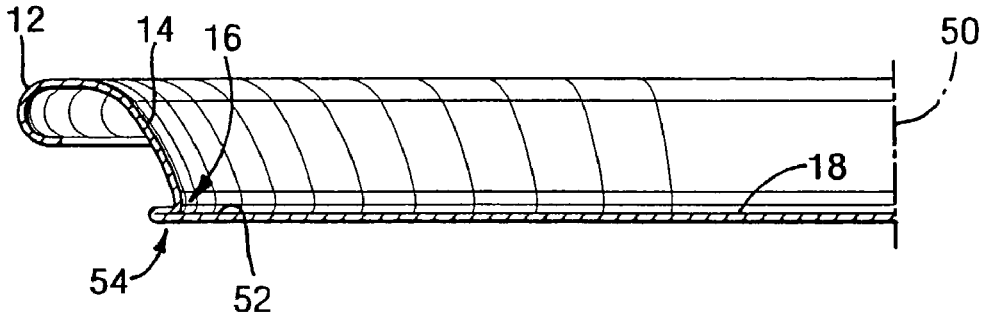
Figure 11:
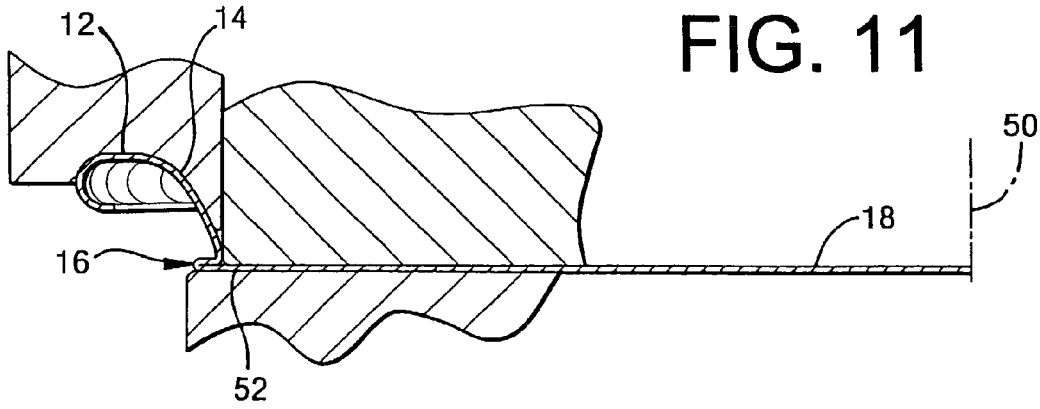

FIGS. 6 and 11 illustrate the second stage of the conversion press. In the second stage, relative movement by the tooling forces the hinge point 82 towards the peripheral edge portion 52. The annular convex portion 64 is fully formed and extends outwardly substantially perpendicular to the longitudinal axis 50. A portion of the hinge point 82 is engaging or very nearly engaging the peripheral edge 52 of the central panel 18.

Figure 7:
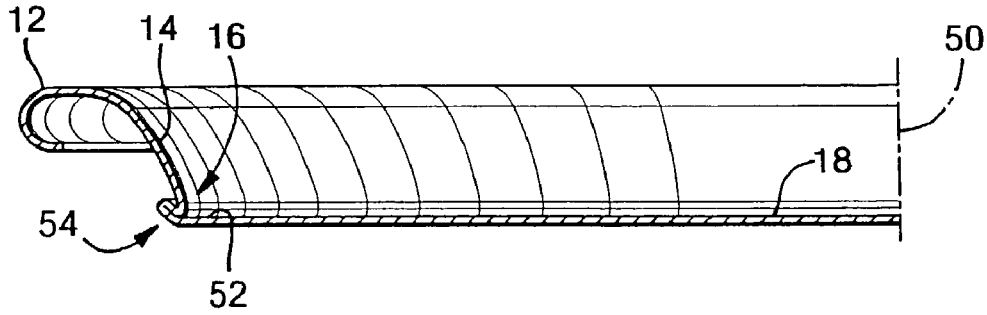
Figure 12:
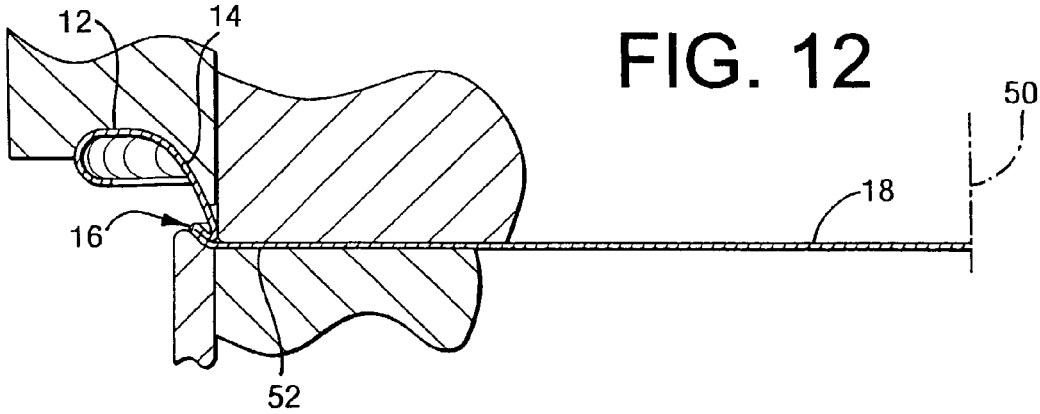

FIGS. 7 and 12 illustrate the third stage of the conversion press. In the third stage, relative movement by the tooling forces the fold 54 upwardly and, consequently, inwardly relative to the central panel 18. This forms the third bend 70 and shortens a radius of curvature of the annular concave portion 58.

Figure 8:
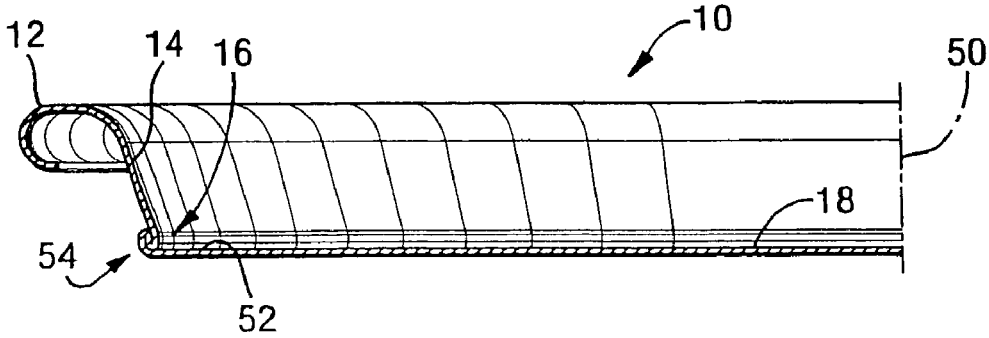
Figure 13:
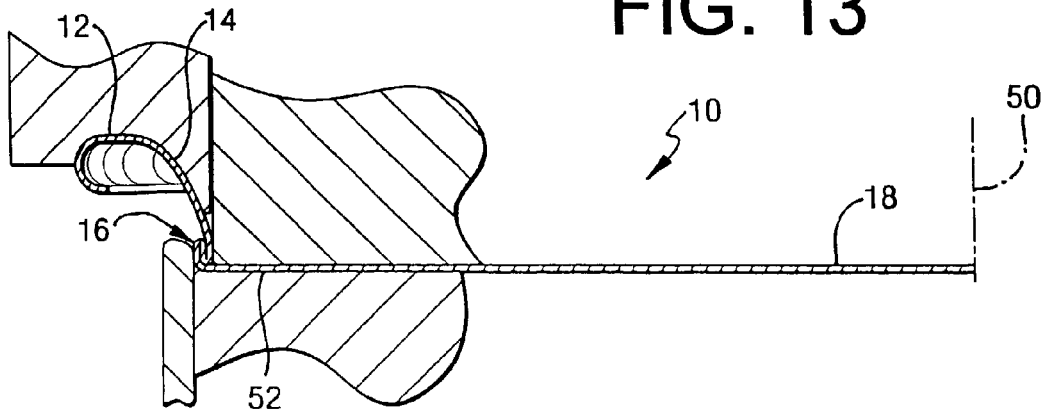

FIGS. 8 and 13 illustrate the fourth stage of the conversion press. In the fourth stage, relative movement by the tooling forces the fold 54 farther upwardly and inwardly relative to the central panel 18 until the fold 54 is substantially vertical, parallel with the longitudinal axis 50. The annular concave portion 58 is fully formed and is in engagement or very nearly in engagement with the peripheral edge portion 52.

Figure 35:
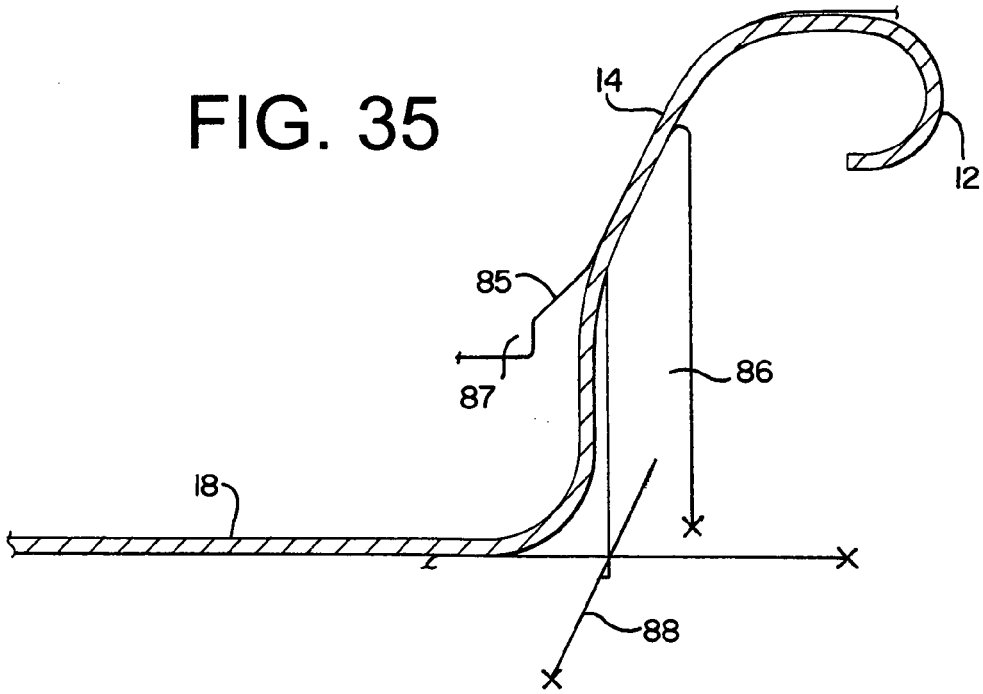
FIGS. 35–37 are partial cross-sectional views of a can end member and alternative tooling of the present invention shown in forming stages.
Figure 36:
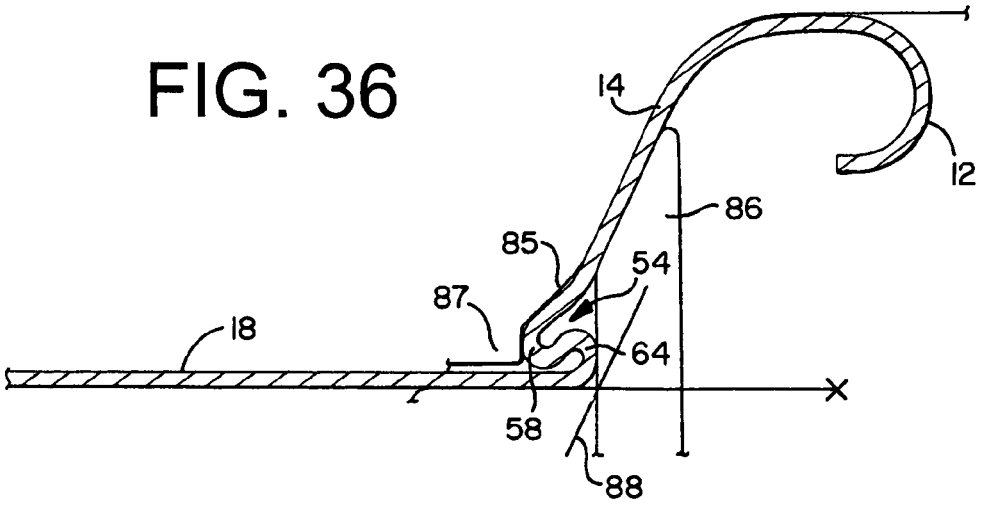
Figure 37:
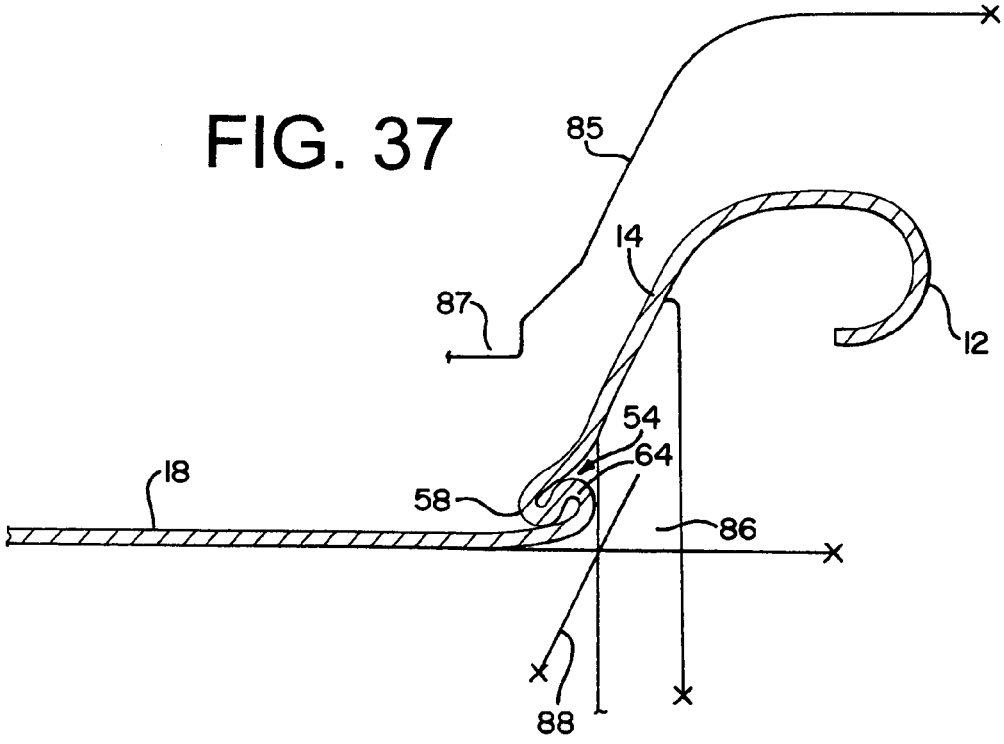

Alternative tooling is illustrated in FIGS. 35–37. The tooling of FIGS. 35–37 forms the fold 54 by forcing metal inwardly, whereas the tooling discussed previously formed the fold 54 by forcing metal outwardly. In FIGS. 35–37, the fold 54 is produced by fixing chuckwall 14 between upper tool 85 and lower 86. Upper tool 85 includes extension 87. The extension 87 prevents the fold 54 from expanding inwardly relative to the longitudinal axis. Thus, the upper and lower tools 85 and 86 maintain the fold 54 in compression. This type of tooling is aimed at maintaining the approximately equal levels of stress at the annular concave and convex portions 58 and 64 to eliminating the premature fracture during forming. A third tool or tool portion 88 forces the fold 54 upwardly and inwardly.

FIGS. 14–21 illustrate numerous embodiments of the can end 10 of the present invention. These embodiments include several design variations aimed improving the strength, stacking, performance, and or cleanliness of the can ends 10.

Figure 14:
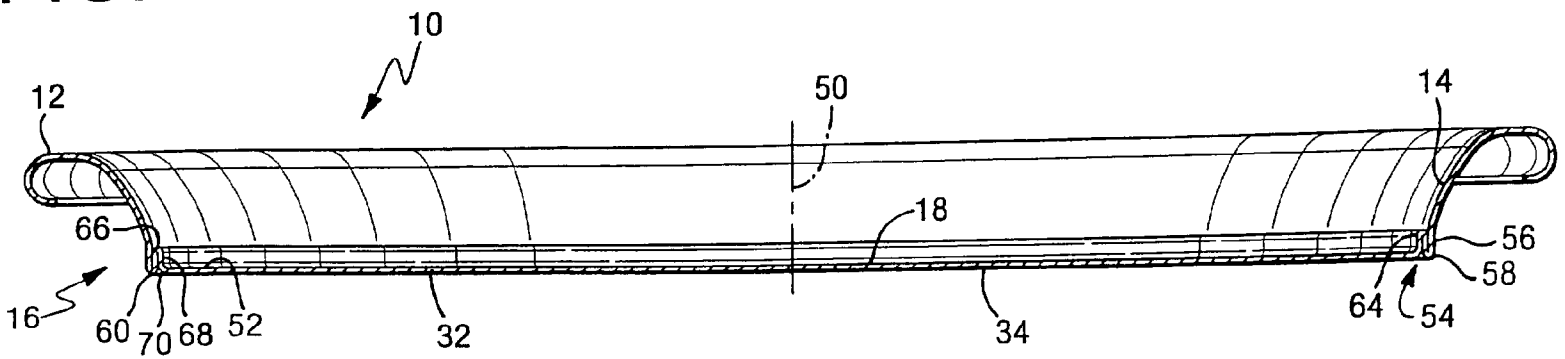
FIG. 14 is a partial cross-sectional view of a can end of the present invention.

FIG. 14 illustrates an alternative embodiment of the can end 10 of the present invention. In this embodiment, the fold 54 extends inwardly relative to the longitudinal axis 50. The annular concave portion 58 does not contact the peripheral edge 52.

Figure 15:
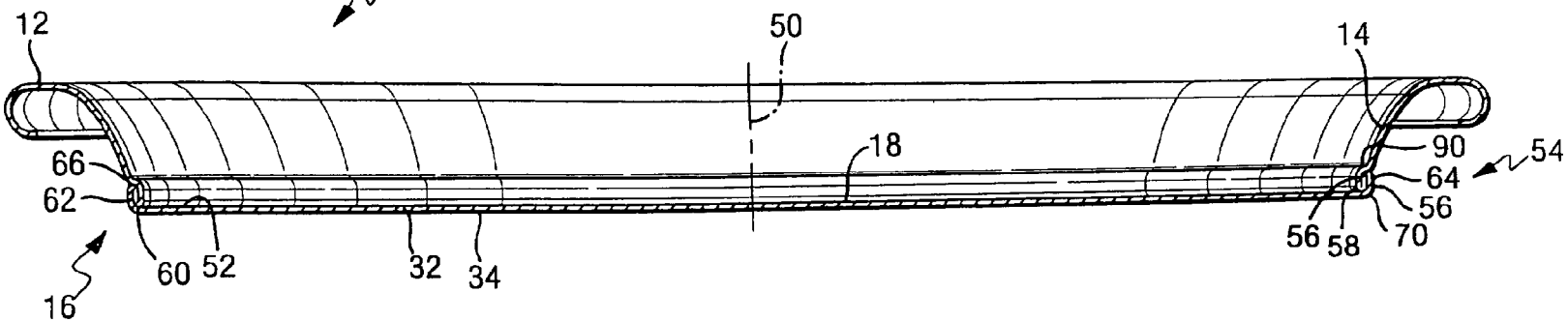
FIG. 15 is a partial cross-sectional view of a can end of the present invention.

FIG. 15 illustrates another embodiment of the can end 10 of the present invention. In this embodiment, the chuckwall 14 includes an outwardly extending step 90 for increased strength. The step 90 bends outwardly against the annular convex portion 64. In this embodiment, the outer portion of the step engages vertical extent of the annular convex portion 64.

Figure 16:
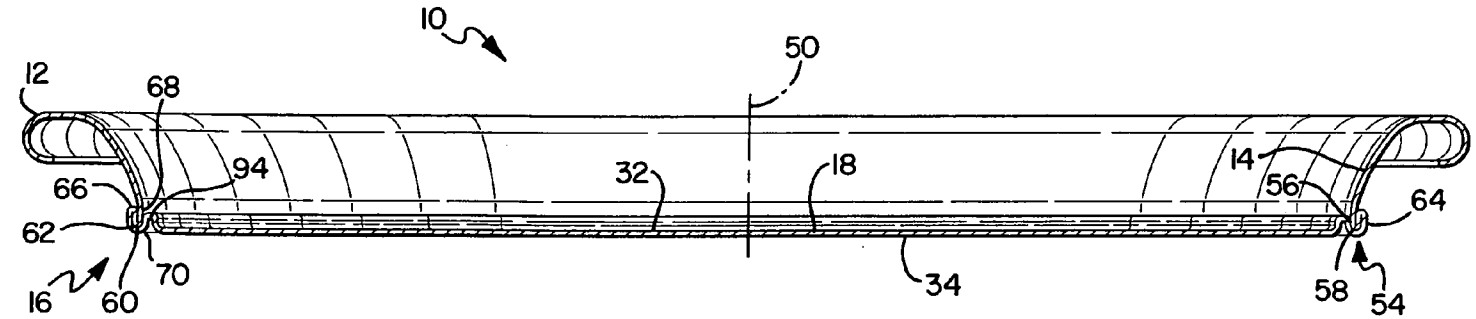
FIG. 16 is a partial cross-sectional view of a can end of the present invention.

FIG. 16 illustrates another embodiment of the can end 10 of the present invention. In this embodiment, the central panel 18 includes an upwardly projecting rib 94. The rib 94 is located along the peripheral edge of the central panel 18.

Figure 17:
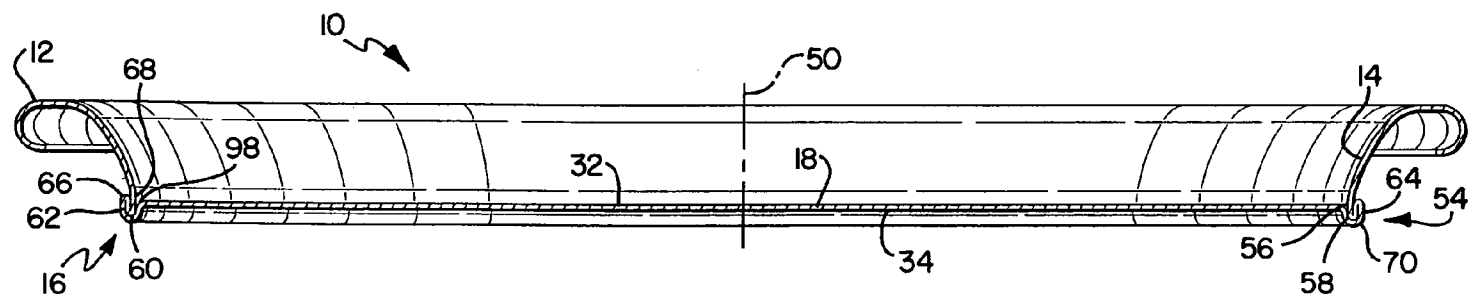
FIG. 17 is a partial cross-sectional view of a can end of the present invention.

FIG. 17 illustrates another embodiment of the can end 10 of the present invention. In this embodiment, the central panel 18 includes an increased height. Accordingly, the central panel 18 includes an upward step 98 at its peripheral edge.

Figure 18:
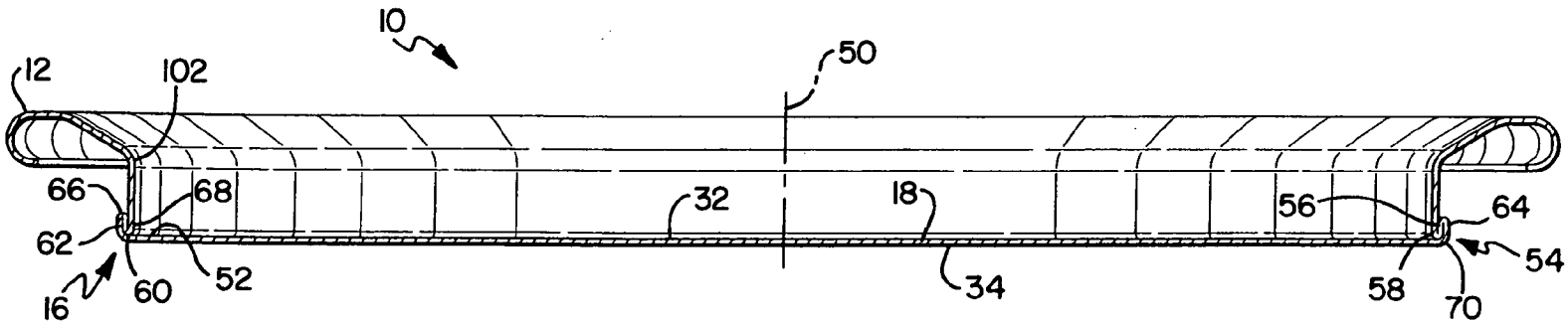
FIG. 18 is a partial cross-sectional view of a can end of the present invention.

FIG. 18 illustrates another embodiment of the can end 10 of the present invention. In this embodiment, the chuckwall 14 includes a bend or kink 102. The kink 102 is directed outwardly relative to the longitudinal axis 50.

Figure 19:
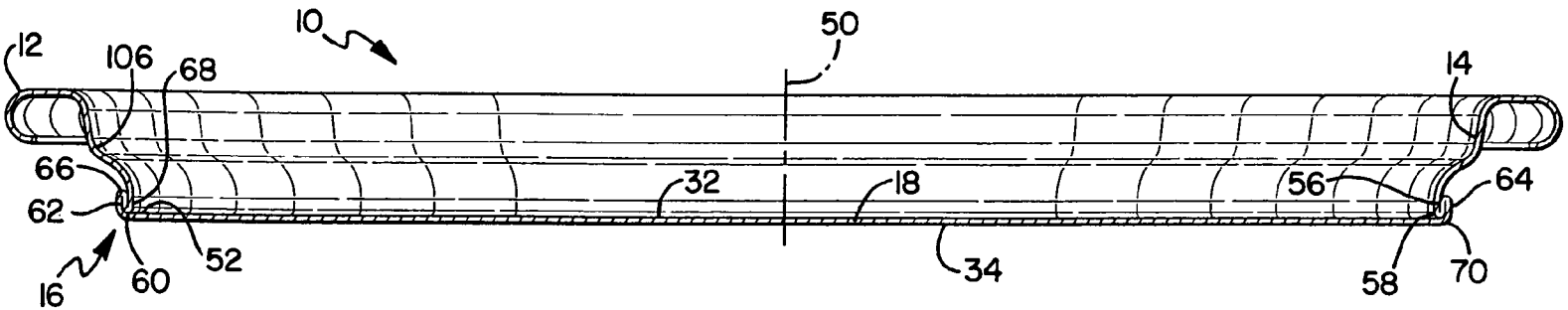
FIG. 19 is a partial cross-sectional view of a can end of the present invention.

FIG. 19 illustrates another embodiment of the can end 10 of the present invention. In this embodiment, the chuckwall 14 includes a stepped-profile 106. The stepped-profile 106 has an upwardly and outwardly directed convex annular portion integral with an upwardly annular concave portion which is interconnected with the seaming curl 12.

Figures 20, 21:
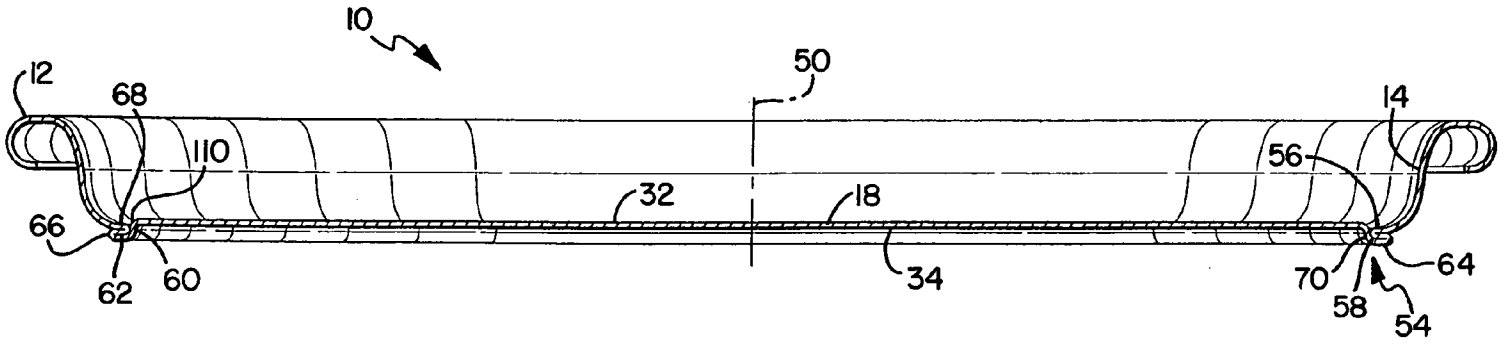
FIG. 20 is a partial cross-sectional view of a can end of the present invention.
FIG. 21 is a partial cross-sectional view of a can end of the present invention.
Figure 30:
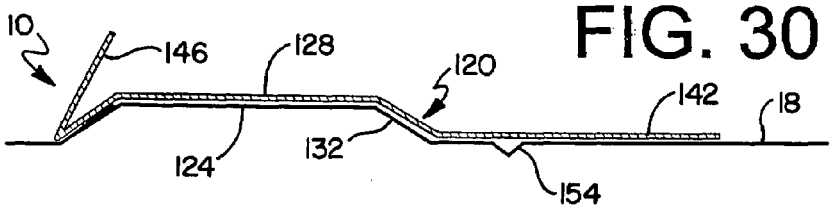
FIG. 30 is a partial cross-sectional view of an embodiment of the can end of the present invention having a peelably bonded closure and a fragrance concentrate reservoir.
Figure 31:
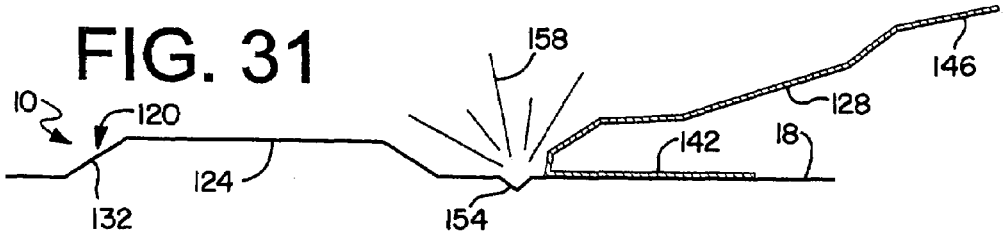
FIG. 31 is a partial cross-sectional view of an embodiment of the can end of the present invention having a peelably bonded closure and a fragrance concentrate reservoir.

FIG. 20 illustrates another embodiment of the can end 10 of the present invention. In this embodiment, the fold 54 is located in a plane which is approximately perpendicular to the longitudinal axis 50. Further, the central panel 18 includes an increased height. The increased height of the central panel 18 brings the central panel 18 at least approximately in a common horizontal plane, perpendicular to the longitudinal axis, with a portion of the first leg 56 of the fold 54. The increased height of the central panel 18 may also bring the central panel 18 into a horizontal plane which lies just above or below a portion of the first leg 56.

FIG. 21 illustrates another embodiment of the can end 10 of the present invention. In this embodiment, the central panel 18 includes a stepped-profile 114 along its peripheral edge. The stepped-profile 114 has an upwardly directed concave annular portion integral with an upwardly annular convex portion which is interconnected with the fold 54.

Now referring to FIGS. 22–34, further embodiments of the present invention are illustrated. In these embodiments, the can end 10 includes a peelably bonded closure. These types of closures are described in PCT International Publication Number WO 02/00512 A1. One ordinary skilled in the art would understand that any of the closures shown in FIGS. 2–21 can be used in combination with the embodiments illustrated in FIGS. 22–34.

The can ends 10 of the embodiments illustrated in FIGS. 22–34 generally include a seaming curl 12, a chuckwall 14, a transition wall 16, and a central panel 18. The central panel 18 includes a flange area 120 defining an aperture 124. A closure member 128, such as a flexible metal foil closure, extends over the aperture 124 and is peelably bonded by a heat seal to a portion of the flange 120. The can ends of these embodiments do not require the formation of a rivet.

The flange 120 is typically an upwardly projecting frustoconical annular surface 132 formed in the central panel 18. It is contemplated that this configuration achieves adequate burst resistance without requiring excessive force to peel the closure member 128.

The frustoconical annular surface 132 defines the shape of the aperture 124. The aperture 124 is preferably a circular shape, but it should be understood that the aperture 124 can be any shape without departing from the spirit of the invention.

Figure 32:
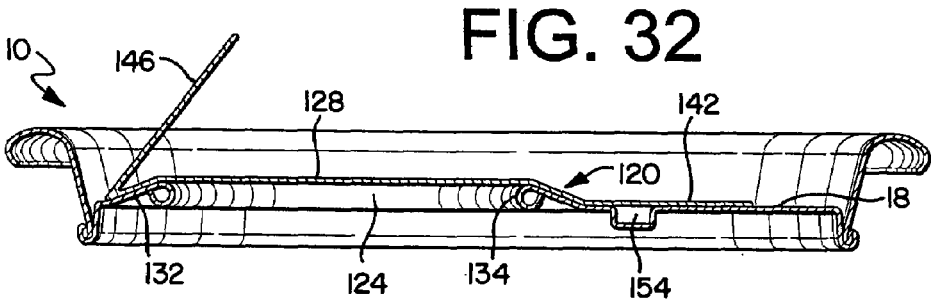
FIG. 32 is a partial cross-sectional view of an embodiment of the can end of the present invention having a peelably bonded closure and a fragrance concentrate reservoir.

A peripheral edge of the frustoconical annular surface 132 is generally formed as a bead 134. The bead 134 protects a drinker's lips from touching and being injured by the cut metal of the peripheral edge of the frustoconical annular surface 132, and avoids damaging the closure member 128 by contact with the cut metal. The bead 134 may have a reverse curl as shown, e.g., in FIG. 23, or a forward curl as shown in FIG. 32. In either case, a horizontal plane P is tangent to an upper extent of the bead 134.

The reverse curl is the preferred method of forming the bead 134. Once the closure member 128 is heat-sealed to the flange 120 surface, the cut metal (typically an aluminum alloy) at the peripheral edge of the frustoconical annular surface 132 must not come into contact with the contained beverage because the cut metal at the edge (unlike the major surfaces of the can end 10) has no protective coating, and would be attacked by acidic or salt-containing beverages. Alternatively, the cut edge may be protected by application of a lacquer to the peripheral edge of the frustoconical annular surface 132.

The flexible closure member 128 is produced from a sheet material comprising metal foil, e.g. aluminum foil, preferably a suitably lacquered aluminum foil sheet or an aluminum foil-polymer laminate sheet. Stated more broadly, materials that may be used for the closure member 128 include, without limitation, lacquer coated foil (where the lacquer is a suitable heat seal formulation); extrusion coated foil (where the polymer is applied by a standard or other extrusion coating process); the aforementioned foil-polymer laminate, wherein the foil is laminated to a polymer film using an adhesive tie layer; and foil-paper-lacquer combinations such as have been used for some low-cost packaging applications.

The closure member 128 extends entirely over the aperture 124 and is secured to the frustoconical annular surface 132 by a heat seal extending at least throughout the area of an annulus entirely surrounding the aperture 124. Since the reverse curl bead 134 does not project beyond the slope of the flange 120 outer surface, the closure member 128 smoothly overlies this bead 134 as well as the flange 120 outer surface, affording good sealing contact between the closure member 128 and the flange 120. The closure member 128 is bonded by heat sealing to the flange 120, covering and closing the aperture 124, before the can end 10 is secured to a can body that is filled with a carbonated beverage.

Once the can end 10 has been attached to the can body, a force applied by a beverage generated pressure causes the flexible closure member 128 to bulge outwardly. An angle σ of the slope of the flange 120 outer surface relative to the plane P of the peripheral edge of the frustoconical annular surface 132 (see FIG. 23) is selected to be such that a line tangent to the arc of curvature of the bulged closure member 128 at the inner edge of the flange 120 lies at an angle to plane P not substantially greater than an angle σ of the slope of the flange 120 outer surface. Since the public side 32 of the can end 10 is substantially planar (and thus parallel to plane P), the angle σ may alternatively be defined as the angle of slope of the flange 120 outer surface to the public side 32 surface (at least in an area surrounding the flange 120).

In FIGS. 23 and 24, the closure member 128 is shown domed to the point at which the frustoconical annular surface 132 is tangential to the arc of the domed closure member 128. In other words, the line of slope of the frustoconical annular surface 132 as seen in a vertical plane is tangent to the arc of curvature of the closure member 128 (as seen in the same vertical plane) at the peripheral edge of the aperture 124.

For these closures, the forces $F_T$ acting on the heat sealed flange area 120 due to the tension in the foil are primarily shear forces, with no significant peel force component acting in tha direction T at 90° to the plane of the frustoconical annular surface 132. Thus, the burst resistance will depend on the shear strength of the heat seal joint or the bulge strength of the foil or foil laminate itself. This provides greater burst resistance relative to standard heat sealed containers which are generally planar.

The frustoconical annular surface 132 provides the slope angle σ which is sufficient to accommodate the extent of doming or bulging of the closure member 128 under the elevated internal pressures for which the can is designed, and thereby enables the burst resistance to be enhanced significantly, for a closure 128 with a peel force which is acceptable to the consumer. The angle σ is between about 12.5° and about 30° to the plane P, and more preferably at least 15°, and most preferably between about 18° and about 25°, or any range or combination of ranges therein. The peel force is dependent both on the inherent properties of the selected heat seal lacquer system, and on geometric effects associated with the complex bending and distortion which the closure member 128 undergoes during peeling.

The circular aperture 124 generally has a diameter D of 20 mm. The aperture 124 is defined by the frustoconical annular surface 132 of the flange 120 which generally has a maximum diameter (in the plane of central panel 18 of 30 mm. Referring to FIG. 26, the closure member 128 has a circular central portion 138 that large is enough to completely overlie the sloping outer surface of the flange 120, i.e. about 32 mm. The closure member 128 includes a short projection 142 on one side for overlying a part of the central panel 18 and an integral tab portion 146 on the opposite side that is not heat sealed but is free to be bent and pulled.

The closure member stock may be a suitable deformable material such as an aluminum foil (e.g. made of alloy AA3104 or of a conventional foil alloy such as AA3003, 8011, 8111, 1100, 1200) with a thickness of 0.002–0.004 inches (approximately 50 μm to 100 μm) which is either lacquered on one side with a suitable heat sealable lacquer, or laminated on one side with a suitable heat sealable polymer film (e.g., polyethylene, polypropylene, etc.), 0.001–0.002 inches (approximately 25 μm to 50 μm) thick. The public side should have a suitable protective lacquer coating. It may be desirable to print onto the foil using known printing methods. It may also be desirable to emboss the laminate to make the closure easier to grip.

The closure member 120 and heat seal must be designed to withstand the force provided by the pressurized contents of a container. Therefore, the closure member 120 must be bonded to withstand tear/shear force resistance that range from 25 lb/in (4.5 kg/cm) to 75 lb/in. (13.4 kg/cm), or any range or combination of ranges therein.

When applied to the can end 10, the portion of the closure member 120 that extends across the aperture 124 may be substantially planar as illustrated in FIG. 27. When the can end 10 is mounted on a container that is filled with a carbonated beverage, the pressure given off by the carbonation causes closure member 128 to bulge upwardly wherein the closure member exhibits a radius of curvature R and a height H above plane P.

Referring to FIG. 29, a stay-on or retainable closure member 128 is illustrated. The closure member 128 includes an annular central portion 138 that is bonded to the frustoconical annular surface 142 of the flange 120. At the side of the aperture 124 adjacent the peripheral edge of the central panel 18, the closure member 128 has an integrally formed pull tab 146. The closure member 128 also has an integral "stay-on" extension 142 opposite the tab 146 and overlying a portion of the central panel 18. The extension 142 is bonded to the can end 10 by a further heat seal portion which is dimensioned to require a substantially greater peeling force (for separating extension 142 from the can end 10) than that required by the annular central portion 138 (for separating the closure member 128 from the angled flange 120 around the aperture 124).

The extension 142 is sealed to the can end 10 by the portion of the heat seal that has a size and shape which requires a substantially higher peel force (greater resistance to peeling) than the annular central portion 138 surrounding the aperture 124. This discourages a consumer from completely removing the closure foil 128. As a result of this design, when the consumer opens the closure 128, the peel will initially be within the targeted range for each opening, e.g. from about 1.8 lb. to 4.5 lb. (about 8N–20N). Then as the aperture 124 is completely opened, the peel force will fall to a very low value so that the consumer will sense that the opening is completed. If the consumer continues to pull the closure, the required peel force will rise rapidly to a value which exceeds the normally accepted easy peel range, i.e. to >5.5 lb. (about 25N).

Another embodiment of the present invention is illustrated in FIGS. 30–34. This embodiment incorporates a fragrance or aroma reservoir 154 that carries an oil or wax based aroma concentrate 158. The concentrate 158 is released when the closure member 128 is peeled back. The aroma is selected to enhance or complement the taste of the beverage.

The reservoir 154, and hence the supply of fragrance 158, are disposed on the side of the aperture 124 away from the peripheral edge of the central panel 18 so as to be close to the user's nose. This location is between the aperture 124 and the stay-on heat seal portion and is thus covered by the closure extension 142 when the closure member 128 is sealed on the can end.

Figure 33:
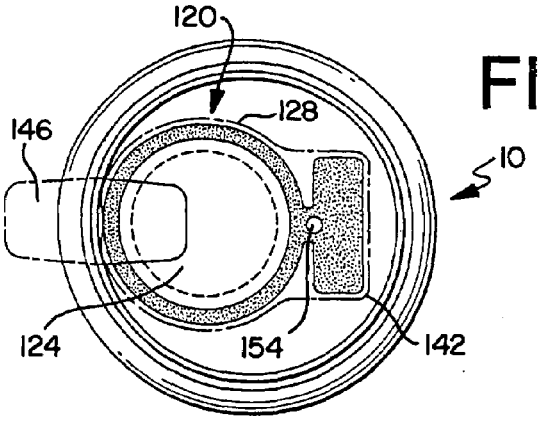
FIG. 33 is a top plan view of a container having a peelable closure and a fragrance concentrate reservoir.
Figure 34:
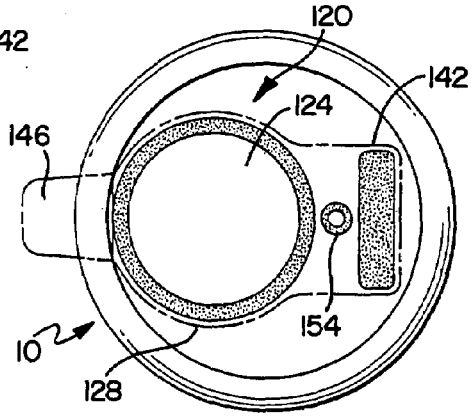
FIG. 34 is a top plan view of a container having a peelable closure and a fragrance concentrate reservoir.

In this embodiment, the closure member 128 is configured to fully surround the reservoir 154 containing the concentrate 158. Two specific heat seal designs for this purpose are respectively shown in FIGS. 33 and 34. In FIG. 33, the heat seal area around the aperture 124 is contiguous with the heat seal area surrounding the fragrance reservoir 154 and the heat seal portion that secures the extension 142 to the can end 10. When the closure 128 is peeled back, the fragrance-containing reservoir 154 will be partially or fully exposed and the concentrate 158 will be released. In FIG. 34, the heat seal area surrounding the reservoir 154 is isolated from the heat seal portions around the aperture 124 and at the extension 142. This method reduces likelihood that the concentrate 158 will evaporate as a result the heat input from the heat sealing tools.

Figure 38:
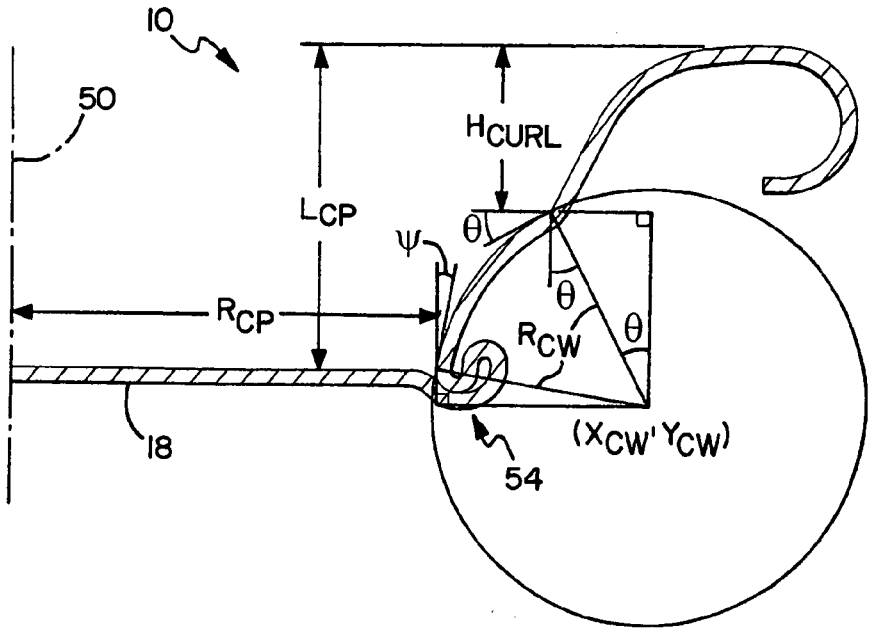
FIG. 38 is a partial cross-sectional view of a can end of the present invention.
Figure 39:
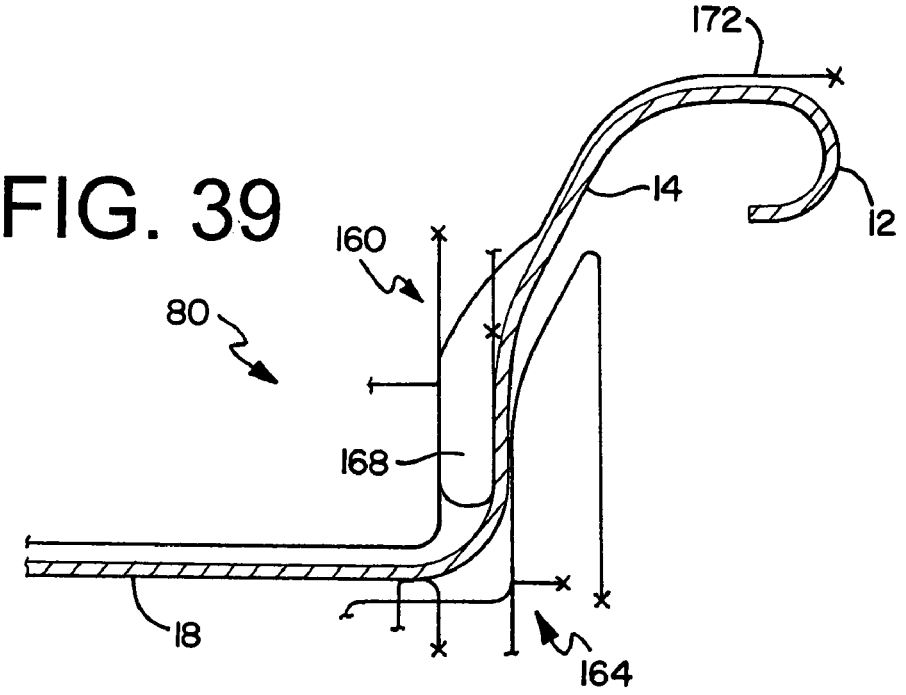
FIGS. 39 and 40 are partial cross-sectional views of a can end member of FIG. 38 and alternative tooling of the present invention shown in forming stages.
Figure 40:
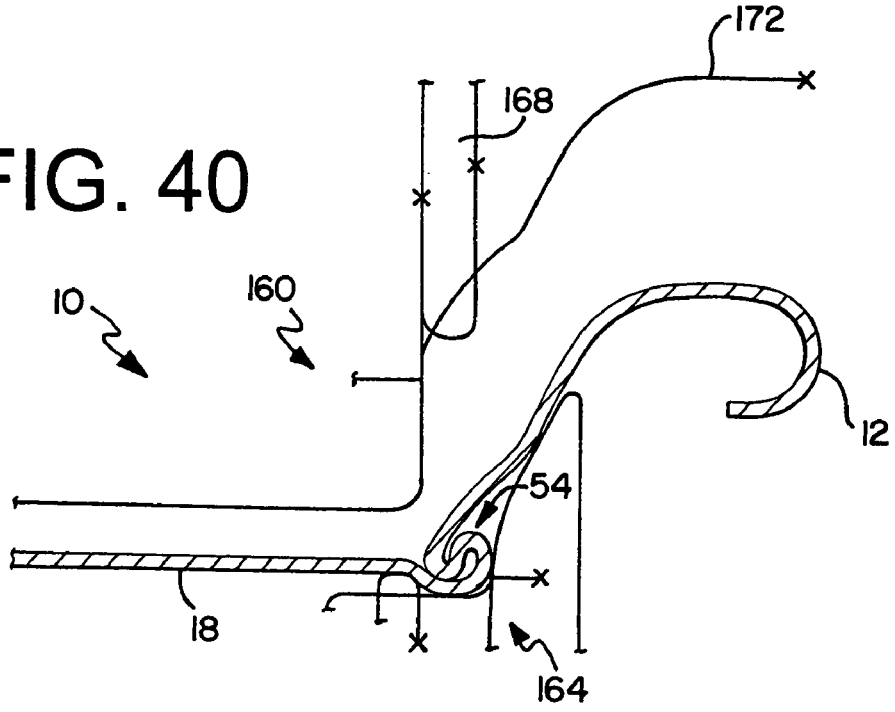

Referring to FIGS. 38–40, another embodiment of the end member 10 of the present invention is illustrated. In this embodiment, the chuckwall 14 includes a stepped-profile 106 similar to FIG. 19. Again, the stepped-profile 106 has an upwardly and outwardly directed convex annular portion integral with an upwardly annular concave portion which is interconnected with the seaming curl 12. A lower portion of the chuckwall 14, or connecting wall, includes a radius of curvature $R_{CW}$, and is angled outwardly at an angle $\psi$ from a line parallel to the longitudinal axis 50. The radius of curvature $R_{CW}$, is chosen in combination with the center panel depth $L_{CP}$, i.e. the distance from the upper extent of the seaming curl 14 to the center panel 18, the center panel radius $R_{CP}$ (measured from a center point at the longitudinal axis to the chuckwall), and the curl height $H_{curl}$, i.e. the distance from the upper extent of the seaming curl 12 to the intersection of the convex annular portion the upwardly annular concave portion, to arrive at a suitable 202 end member (having a diameter of 2.33 in. to 2.35 in. (5.92 cm to 5.97 cm).

The chuckwall 14 panel depth can be expressed in terms of the following relationships:

$$X_{CW}=R_{CP}+R_{CW}\cos\psi;$$

$$Y_{CW}=R_{CW}\sin\psi;$$

$$L_{CP}=H_{curl}+R_{CW}(\cos\theta-\sin\psi);$$

$$R_{CW}^2=Y_{CW}^2+(X_{CW}-R_{CP})^2;\text{ and}$$

$$L_{CP}=H_{curl}+\{[Y_{CW}^2+(X_{CW}-R_{CP})^2]^{1/2}*(\cos\theta-\sin\psi)\};$$

where $X_{CW}$ is the center of the arc of curvature of the lower portion of the chuckwall 14, measured as a horizontal distance from the longitudinal axis 50; $Y_{CW}$ is the center of the arc of curvature of the lower portion of the chuckwall 14, measured as a vertical distance above or below the central panel 18; and the angle $\theta$ is the angle measured between a line perpendicular to the longitudinal axis 50 and an uppermost segment of the lower portion of the chuckwall 14.

The center panel depth $L_{CP}$ ranges from 0.160 in. to 0.250 in. (0.406 cm to 0.635 cm), more preferably 0.180 in. to 0.240 in. (0.457 cm to 0.610 cm), or any range or combination of ranges therein. The center panel diameter, double the value of $R_{CP}$, ranges from 1.380 in. to 1.938 in. (3.505 cm to 4.923 cm), more preferably 1.830 in. to 1.880 in. (4.648 cm to 4.775 cm), or any range or combination of ranges therein. The radius of curvature $R_{CW}$ varies accordingly to arrive at a 202 end member 10, but is typically 0.070 in. to 0.205 in. (0.229 cm to 0.521 cm), but can be any value less than infinite. In other words, assuming a fixed center panel height, as the center panel diameter increases the radius of curvature $R_{CW}$ increases. The following table illustrates this relationship.

TABLE 1

| Center Panel Height | Center Panel Diameter | Radius of Curvature ($R_C$) |
|---|---|---|
| 0.180 in. | 1.831 in. | 0.0854 in. |
| 0.180 | 1.855 | 0.0863 |
| 0.180 | 1.878 | 0.0898 |
| 0.210 | 1.831 | 0.1123 |
| 0.210 | 1.855 | 0.1272 |
| 0.210 | 1.878 | 0.1385 |
| 0.240 | 1.831 | 0.1665 |
| 0.240 | 1.855 | 0.1803 |
| 0.240 | 1.878 | 0.2016 |

The end member 10 of FIG. 38 can be formed using the tooling shown in FIGS. 38 and 39. The tooling includes upper tooling 160 and lower tooling 164. The upper tooling 160 has an intermediate member 168. Relative movement between the upper tooling 160 and the lower tooling 164 causes the intermediate member 168 to engage the peripheral edge of the shell member 80, forcing the peripheral edge downwardly to form a recess. The intermediate member 168 retracts, and an outer member 172 engages the chuckwall 14. As the chuckwall 14 is forced downwardly, the fold 54 is formed between the lower tooling 164 and the outer member 172.

Several alternative embodiments have been described and illustrated. A person ordinary skilled in the art would appreciate that the features of the individual embodiments, for example, stay-on closures and center panel and chuckwall reforming can be applied to any of the embodiments. A person ordinary skilled in the art would further appreciate that any of the embodiments of the folded transition wall could be provided in any combination with the embodiments disclosed herein. Further, the terms "first", "second", etc. are used for illustrative purposes only and are not intended to limit the embodiments in any way.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. An easy open can end member comprising:

a central panel positioned about a longitudinal axis, the central panel including a closure member for sealing the end member, a portion of the closure member is retainable to a portion of the central panel once the easy open can end member is opened;

a curl defining an outer perimeter of the end member;

a circumferential chuckwall extending downwardly from the curl; and a fold directly connected to the chuckwall and joining the chuckwall with the central panel.

2. The easy open can end member of claim 1 wherein the fold extends outwardly relative to the longitudinal axis.

3. The easy open can member of claim 2 wherein the fold further extends upwardly relative to the central panel.

4. The easy open can member of claim 1 wherein the fold has a length less than a length of the curl.

5. The easy open can member of claim 1 wherein the chuckwall extends downwardly from the curl at an obtuse angle and the fold has a thickness that is less than a length of the chuckwall.

6. The easy open can member of claim 1 wherein the fold comprises an annular concave bend extending downwardly from the chuckwall and an annular convex bend extending upwardly from the annular concave bend and interconnected to the central panel.

7. The easy open can end member of claim 6 wherein the fold further comprises a third bend joining the annular convex bend with the central panel.

8. The easy open can end member of claim 7 wherein the third bend has a radius of curvature substantially defined by a lower extent of the annular concave bend.

9. The easy open can end member of claim 1 wherein the fold includes an annular concave portion in engagement with the peripheral edge of the central panel.

10. The easy open can end member of claim 9 wherein the concave annular portion includes an apex, the apex being in engagement with the peripheral edge of the central panel.

11. The easy open can end member of claim 1 wherein the fold further extends upwardly relative to the central panel, the fold having a thickness which is substantially less than a length of the chuckwall.

12. The easy open can end member of claim 1 wherein the closure member comprises a tear panel defined by fracturable score, the tear panel retained to the central panel along a non-scored hinge region.

13. The easy open can end member of claim 1 wherein the central panel further comprises an aperture defined by a flange, and the closure member comprises a flexible metal foil peelably bonded to a portion of the flange.

14. The easy open can end member of claim 13 wherein the flange includes a frustoconical annular surface projecting upwardly from the central panel, the frustoconical annular surface having an upwardly sloping outer surface and an annular inner edge lying substantially in a plane and defining the aperture.

15. The easy open can end member of claim 14 wherein the frustoconical annular surface slopes upwardly at an angle between about 12.5° and about 30° to the central panel.

16. The easy open can end member of claim 15 wherein the closure member comprises a metal foil, the closure member extending entirely over the aperture and peelably bonded to the frustoconical annular surface around said aperture.

17. The easy open can end member of claim 16 wherein the closure member is bonded to have a tear/shear force resistance of at least about 25 lb./in.

18. The easy open can end member of claim 17 wherein the tear/shear force resistance is between about 25 and about 75 lb./in.

19. The easy open can end member of claim 16 wherein the closure member material is deformable, and wherein an average diameter of the aperture, the angle of slope of the flange, and the deformability of the material are mutually selected such that the closure member, when subjected to differential pressures up to at least about 90 p.s.i. in the can, bulges upwardly with an arc of curvature such that a line tangent to said arc at said inner edge of said flange lies at an angle to said plane not substantially greater than said angle of slope of the flange outer surface.

20. The easy open can end member of claim 16 wherein the closure member material is deformable, and wherein the average diameter of the aperture, the angle of slope of the flange, and the deformability of the material are mutually selected such that the closure member, when subjected to differential pressures up to at least about 100 p.s.i. in the can, bulges upwardly with an arc of curvature such that a line tangent to the arc at the inner edge of the flange lies at an angle to the plane not substantially greater than the angle of slope of the flange outer surface.

21. The easy open can end member of claim 16 wherein the closure member and the heat seal have a tear/shear force resistance of at least about 75 lb./in., and wherein the average diameter of the aperture and the angle of slope of the flange are mutually selected such that when the closure member is subjected to differential pressure of not more than about 90 p.s.i. within the can, the tear/shear force exerted on the closure member and heat seal does not exceed said tear/shear force resistance.

22. The easy open can end member of claim 16 wherein the closure member and the heat seal have a tear/shear force resistance of at least about 75 lb./in., and wherein the average diameter of the aperture and the angle of slope of the flange are mutually selected such that when the closure member is subjected to differential pressure of not more than about 100 p.s.i. within the can, the tear/shear force exerted on the closure member and heat seal does not exceed the tear/shear force resistance.

23. The easy open can end member of claim 22 wherein the closure member and the heat seal have a tear/shear force resistance of at least about 75 lb./in., and wherein the average diameter of said aperture and said angle of slope of the flange are mutually selected such that when the closure member is subjected to differential pressure of not more than about 90 p.s.i. within the can, the tear/shear force exerted on the closure member and the heat seal does not exceed the tear/shear force resistance.

24. The easy open can end member of claim 23 wherein the closure member and the heat seal have a tear/shear force resistance of at least about 75 lb./in., and wherein the average diameter of the aperture and the angle of slope of the flange are mutually selected such that when the closure member is subjected to differential pressure of not more than about 100 p.s.i. within the can, the tear/shear force exerted on the closure member and heat seal does not exceed the tear/shear force resistance.

25. The easy open can end member of claim 16 wherein the heat seal has a 90° peel strength between about 8 N and about 20 N.

26. The easy open can end member of claim 16 wherein the annular inner edge is formed with a reverse bead curl.

27. The easy open can end member of claim 26 wherein the reverse bead curl is substantially tangent to the upwardly sloping outer surface of the flange.

28. The easy open can end member of claim 16 wherein the metal foil is aluminum alloy foil.

29. The easy open can end member of claim 28 wherein the aluminum alloy foil has a thickness between about 0.003 inch and about 0.004 inch.

30. The easy open can end member of claim 16 wherein the heat seal is formed as an annulus surrounding the aperture and having a width between about 0.079 inch and about 0.118 inch.

31. The easy open can end member of claim 16 wherein the closure has a tab portion with a manually graspable free end and an extension overlying said central panel in opposed relation to the tab portion, said heat seal including an annulus surrounding the aperture and a further seal portion bonding the extension to the central panel lid such that the peel force required to separate the extension from the central panel lid is greater than that required to separate the closure member from the central panel at the annulus, whereby the aperture can be opened by peeling back the closure member while the closure member remains secured to the lid by the further seal portion.

32. The easy open can end member of claim 31 including a fragrance-providing material disposed between the closure member and the central panel and surrounded by the heat seal such that when the closure member is subjected to a peel force effective to open the aperture, the fragrance-providing material becomes exposed.

33. The easy open can end member of claim 16 including a fragrance-providing material disposed between the closure member and the central panel and surrounded by the heat seal such that when the closure member is subjected to a peel force effective to open the aperture, the body of fragrance-providing material becomes exposed.

34. An easy open can end member comprising:

a central panel centered about a longitudinal axis, the central panel having a peripheral edge;

a curl defining an outer perimeter of the end member;

a circumferential chuckwall extending downwardly from the curl; and a transition wall connecting the chuckwall with the peripheral edge of the central panel, the transition wall comprising a folded portion comprising a convex annular apex joining a first leg and a second leg, the first leg joining the transition wall with the chuckwall, and the second leg joining the transition wall with the peripheral edge, the convex annular apex located outwardly of a lower portion of the chuckwall.

35. The easy open can end member of claim 34 wherein the central panel includes a stepped-profile along the peripheral edge, the stepped-profile having an upwardly directed concave annular portion integral with an upwardly annular convex portion which is interconnected with the folded portion.

36. An easy open can end member including a stay-on closure member comprising:

a central panel centered about a longitudinal axis having a public side and a product side;

a curl defining an outer perimeter of the end member;

a circumferential chuckwall extending downwardly from the curl; and a transition wall connecting the chuckwall with the peripheral edge of the central panel, the transition wall comprising a fold including a concave annular portion extending downwardly and approaching the peripheral edge of the public side of the central panel.

37. An end member for a container comprising:

a central panel positioned about a longitudinal axis;

a curl defining an outer perimeter of the end member, the curl having an upper extent located a first distance above the central panel; and a circumferential chuckwall extending upwardly from the central panel at an angle from a vertical line, the chuckwall including a lower portion having a radius of curvature wherein the curl is located at a second distance above an uppermost segment of the lower portion and the first distance is expressed using the following relationship:

$$L_{CP}=H_{curl}+R_{CW}(\cos\theta+\sin\psi)$$

$$L_{CP}=H_{curl}+R_{CW}(\cos\theta-\sin\psi)$$

wherein $L_{CP}$ is the first distance, $H_{curl}$ is the second distance, $R_{CW}$ is the radius if curvature of the lower portion of the chuckwall, the angle $\psi$ is the angle between the lower portion of the chuckwall and the vertical line, and the angle $\theta$ is an angle measured between a line perpendicular to the longitudinal axis and the uppermost segment of the lower portion of the chuckwall.

38. The end member of claim 37 wherein $L_{CP}$ is between 0.180 in. to 0.240 in.

39. The end member of claim 37 wherein the central panel has a diameter between 1.380 in. to 1.938 in.

40. The end member of claim 37 wherein $R_{CW}$ is between 0.085 in. to 0.205 in.

41. An easy open can end member comprising:

a central panel positioned about a longitudinal axis, the central panel including a closure member for sealing the end member, a portion of the closure member is retainable to a portion of the central panel once the easy open can end member is opened;

a curl defining an outer perimeter of the end member;

a circumferential chuckwall extending downwardly from the curl; and a fold located between the chuckwall and the central panel, the fold extending radially outwardly of a lower portion of the chuckwall.

* * * * *